US006645040B2

(12) United States Patent
Rabinowicz et al.

(10) Patent No.: US 6,645,040 B2
(45) Date of Patent: Nov. 11, 2003

(54) TWO-PLY SUPPORT GARMENT AND METHOD OF MAKING SAME

(75) Inventors: Sigi Rabinowicz, Beni-Brak (IL); Meir Azulay, D.M. Misgav (IL)

(73) Assignee: Tefron Ltd., Bnei-Brak (IL)

( * ) Notice: Subject to any disclaimer, the term of this patent is extended or adjusted under 35 U.S.C. 154(b) by 0 days.

(21) Appl. No.: 10/037,073

(22) Filed: Nov. 9, 2001

(65) Prior Publication Data

US 2003/0092355 A1 May 15, 2003

(51) Int. Cl.[7] ..... A41C 3/00
(52) U.S. Cl. ..... 450/1; 450/92
(58) Field of Search ..... 450/20, 21, 74–76, 450/39, 40, 43, 53, 59, 60, 41, 44, 47, 48, 92, 93, 1, 3, 4, 7, 8, 94, 109, 114, 131, 115–118, 122–124, 143, 151, 156; 2/243.1, 272, 400–408, 67; 66/176, 8, 171, 177, 172 R, 175, 196, 197

(56) References Cited

U.S. PATENT DOCUMENTS 4,143,662 A * 3/1979 Fisher ..... 450/41
4,557,267 A * 12/1985 Cole ..... 450/1
5,447,462 A * 9/1995 Smith et al. ..... 450/122
5,553,468 A * 9/1996 Osborne ..... 66/171
5,660,577 A * 8/1997 Modena ..... 450/41
5,916,829 A * 6/1999 Girard et al. ..... 450/122
6,000,994 A * 12/1999 Salotto ..... 450/92
6,180,178 B1 * 1/2001 Vogt ..... 450/41
6,238,266 B1 * 5/2001 Vogt ..... 450/20
6,287,168 B1 * 9/2001 Rabinowicz ..... 66/171
6,439,959 B1 * 8/2002 Magrone et al. ..... 450/41

* cited by examiner

*Primary Examiner*—Gloria M. Hale
(74) *Attorney, Agent, or Firm*—Alston & Bird LLP

(57) ABSTRACT

A two-ply support garment such as a brassiere, panty, or the like, is made by positioning a piece of heat-bondable polymer film between two fabric plies of a two-ply fabric blank in one or more selected areas that will become portions of the garment, heating the film to bond the plies to the opposite faces of the film in the one or more selected areas, and fashioning a two-ply garment from the blank. A brassiere embodiment includes the film in partial regions of the cups, in a central panel between the cups, and in side panels of the brassiere.

24 Claims, 4 Drawing Sheets

TWO-PLY SUPPORT GARMENT AND METHOD OF MAKING SAME

FIELD OF THE INVENTION

The present invention relates to support garments such as brassieres, body-shaping panties and briefs, and the like.

BACKGROUND OF THE INVENTION

Designers of support garments are in a never-ending quest for increased levels of support and shaping while improving the comfort to the wearer and reducing the cost of manufacturing. These factors tend to be mutually exclusive to some extent. With conventional brassieres, for example, greater support and shaping have generally been achieved only at the expense of reduced comfort, particularly in the case of underwire brassieres. It has also been necessary in general to use the cut-and-sew process to make brassieres providing substantial support, as exemplified for instance by U.S. Pat. No. 4,372,322 issued to Stern et al. A brassiere made in this manner may consist of more than a dozen separate fabric pieces individually cut out and sewn together. One advantage of the cut-and-sew method is that different areas of the brassiere can be given different properties, since the various fabric pieces can be of different knits, different yarns, etc. It may be advantageous, for example, to make some portions of the brassiere resiliently stretchable to hug the wearer's body, while other portions are relatively unstretchable for greater stability. The cut-and-sew method, however, entails a great number of cutting and sewing operations, and therefore is relatively costly. The resulting seams in the brassiere can also be uncomfortable and are often visible under close-fitting clothing.

Accordingly, methods of fashioning garments from circularly knit fabrics have been developed in an effort to improve the speed and efficiency of production and to reduce the number of unsightly and uncomfortable seams. For example, commonly assigned U.S. Pat. Nos. 5,479,791 and 5,592,836 disclose methods for making non-underwire brassieres from circularly knit tubular blanks. The brassieres are made from single-ply tubular blanks that have a turned welt at one end to form a torso-encircling portion of the brassiere. A series of courses for defining cups and front and rear shoulder straps are integrally knit to the turned welt. The brassiere requires sewing only for joining the front and rear shoulder straps to each other. The circular knitting process greatly reduces the amount of human labor required to fashion a brassiere, thereby reducing the cost of manufacturing significantly, and the brassiere has a greatly improved appearance under close-fitting clothing.

The potential drawback of the seamless circular knit process is that a garment made in this fashion may not provide as much support and shaping as a conventional cut-and-sew garment, unless deliberate steps are undertaken to improve the support and shaping. For instance, the '836 patent discloses modifying the knit structure along outer edges of the cups nearest the wearer's arms to form panels having a greater resistance to coursewise stretching than the remainder of the fabric blank. The relatively unstretchable panels provide increased lift and support.

As another example, commonly assigned U.S. Pat. No. 6,287,168 issued Sep. 11, 2001 describes a circular-knit brassiere made as a two-ply structure by knitting a single-ply fabric tube and folding it to form a two-ply tube from which the brassiere is cut. The knit construction in the central panel between the cups is modified so that it is substantially less stretchable than the remainder of the brassiere, thereby providing greater stability to the cups. The brassiere even in non-underwire form provides a reasonably good level of support, while being considerably more comfortable than a traditional underwire, and the manufacturing process is significantly less costly than a conventional cut-and-sew process. However, women who are accustomed to the reassuring feeling of underwires pressing against the body beneath the breasts may perceive the absence of that feeling as a lack of support. What would be desirable is a substantially seamless non-underwire brassiere giving the wearer a feeling similar to that of an underwire brassiere. Additionally, it would be desirable to be able to easily tailor the support and resistance to stretch of different areas of a brassiere or other support garment without having to use the costly cut-and-sew process.

SUMMARY OF THE INVENTION

The present invention represents a further development in the technology of support garments as described above. In accordance with the present invention, a two-ply support garment with differential stretch and support is made by positioning a heat-bondable polymer film between two fabric plies in one or more selected areas that will become portions of the garment, heating the film to cause the film to bond to the plies in the one or more selected areas, and fashioning a two-ply garment from the resulting fabric blank. The film bonded between the plies increases the resistance to stretching of the fabric and thus provides increased support and/or shaping properties to the area(s) of the garment in which it is located. The invention thus provides a relatively easy and inexpensive way to precisely tailor the support and shaping of various regions of a support garment while avoiding the time-consuming and costly cut-and-sew process. Furthermore, although the preferred heat-bondable film is substantially transparent, the film when bonded between the fabric plies increases the opacity of the fabric, providing enhanced modesty in those areas in which the film is located. The film can also be colored, if desired, to reduce the transparency of the film and thereby provide further-enhanced modesty.

In preferred embodiments of the invention, heat-bondable films of different resistance to stretching can be used in various regions of a garment to provide different degrees of support and/or shaping in those regions. The different resistance to stretching can be accomplished by varying the thickness and/or material properties of the film. In particular, the modulus of the film can be different in different regions of the garment.

A preferred film comprises an elastically stretchable polyurethane film. The film can be made to have a relatively low resistance to stretching for providing resilient support in certain regions of a garment, such as in lower regions of the cups of a brassiere. The film can be made to have a relatively high resistance to stretching to substantially prevent stretching in other regions of the garment, such as in the central region between the cups of a brassiere.

In a preferred embodiment of the invention, a fabric blank for making a brassiere is formed by circularly knitting a fabric tube and folding the fabric (either in tube form or after slitting the tube lengthwise to form a flat blank) to form the two-ply blank. The heat-bondable film preferably is positioned to extend over bottom portions of the cups, while the fabric plies in the remainder of the cups are not bonded together. The bottom portions of the cups are thereby made substantially less stretchable than the other portions, thus enhancing the support where it is needed. If enhanced modesty is desired, the heat-bondable film in the bottom portions of the cups can be extended up to cover the nipples. The heat-bondable film can also be provided in other areas, such as in the central panel between the cups. Preferably, the film in the central panel has a greater resistance to stretching than the film used in the cups. The heat-bondable film can also be provided in the portions of the brassiere that extend below the cups and from the outer edges of the cups around the wearer's back if it is desired to reduce the stretch in these areas. Preferably, each type of heat-bondable film to be included in the garment is cut to the desired size and shape and is then positioned between the plies and heat and pressure are applied to the plies to bond the plies together. The invention thereby makes it easy to tailor the support of various regions of a garment in a precise manner.

A two-ply body-shaping panty in accordance with the invention can be provided with shaping panels having a relatively higher resistance to stretching than the rest of the panty, by positioning appropriately configured pieces of heat-bondable film between the plies of a two-ply fabric blank and heating the film to bond the film to the plies. The blank is then used to fashion a panty. Other types of support garments can also be made according to the principles of the present invention.

The heat-bondable film can be heated by various techniques. For instance, the garment with the film disposed between the plies can be placed in a heated press and pressed between the heated press members. Alternatively, the film can be ultrasonically heated to bond it to the fabric plies.

BRIEF DESCRIPTION OF THE DRAWINGS

The above and other objects, features, and advantages of the invention will become more apparent from the following description of certain preferred embodiments thereof, when taken in conjunction with the accompanying drawings in which.

DETAILED DESCRIPTION OF THE INVENTION

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Figure 1:
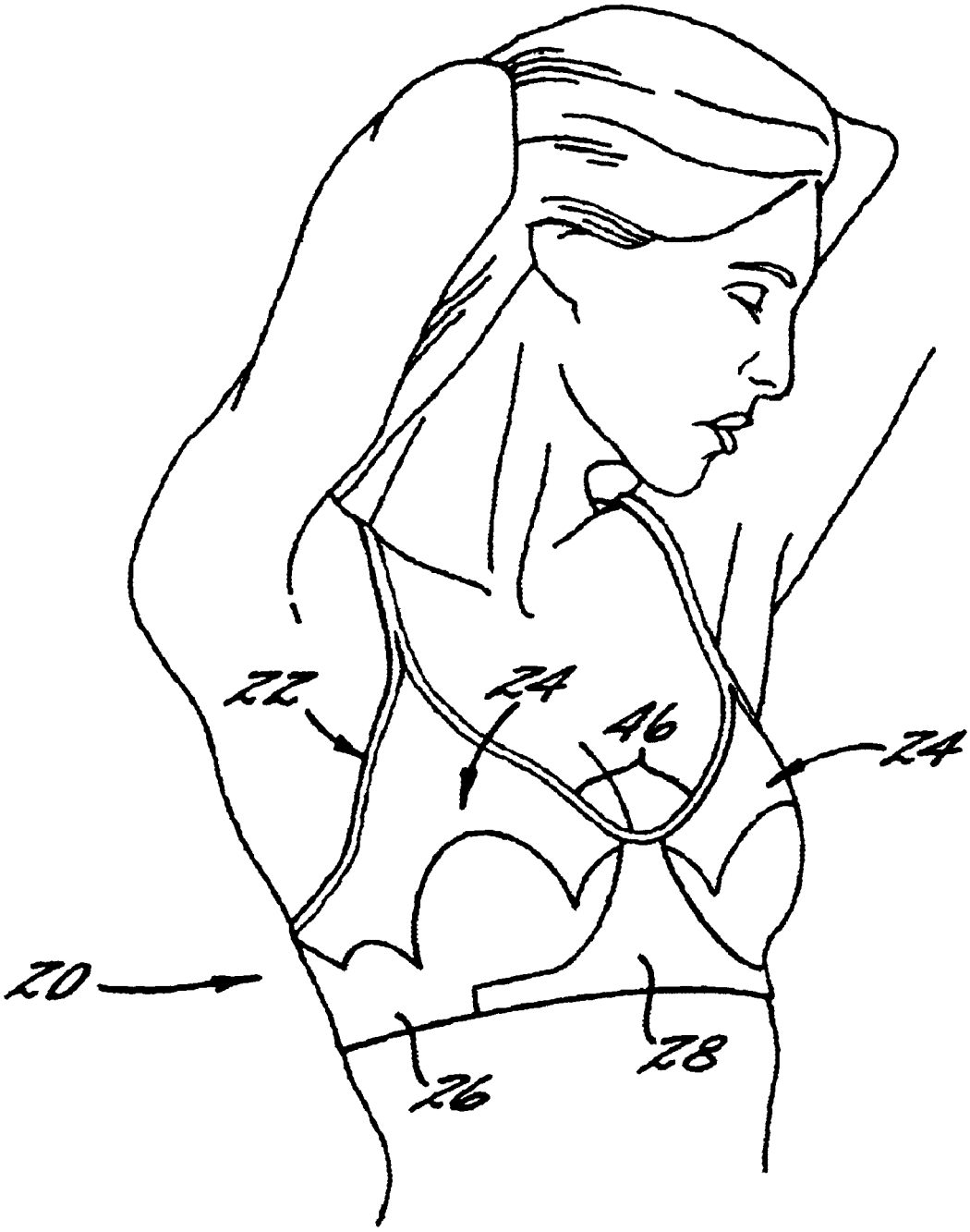
FIG. 1 is a perspective view of a person wearing a brassiere in accordance with one embodiment of the present invention.

With reference to FIG. 1, a substantially seamless brassiere in accordance with a preferred embodiment of the invention is broadly designated by reference numeral 20. The brassiere 20 includes a body-covering portion 22 comprising a pair of cups 24, a torso-encircling portion 26, and a central panel 28 extending between the cups. The brassiere also includes a pair of shoulder straps 30 attached to the body-covering portion 22.

The cups 24 and torso-encircling portion 26 can be knit from various types of face yarns depending on the desired properties of the fabric, and the face yarns can be of various deniers, the selection of the face yarns and the knit depending primarily on the desired characteristics of the fabric such as the hand, appearance, texture, etc. The cups 24 and torso-encircling portion 26 preferably also incorporate elastomeric yarns such as spandex (bare and/or covered) or the like so as to impart resiliency to the fabric. A central panel 28 extends between the cups 24.

The brassiere 20 has the torso-encircling portion 26 formed in two halves comprising one lateral panel each attached to one of the cups 24. The free end of one of the halves of the torso-encircling portion has fastener members 38, such as hooks, attached to it, and the free end of the other half of the torso-encircling portion has cooperative fastener members 40, such as eyes, attached to it for engagement with the opposite fastener members 38 so that the brassiere can be secured about the wearer's torso.

The brassiere 20 has a two-ply construction. More particularly, the cups 24, torso-encircling portion 26, and central panel 28 are all formed from a single continuous piece of fabric that is folded upon itself to define an inner ply that faces the wearer's body and an outer ply that faces outward. The fold line of the fabric forms the bottom edge of the brassiere. The two plies are affixed to each other along the upper peripheral edges of the cups and torso-encircling portion, preferably by sewing elastic banding 46 along these edges.

Figure 2:
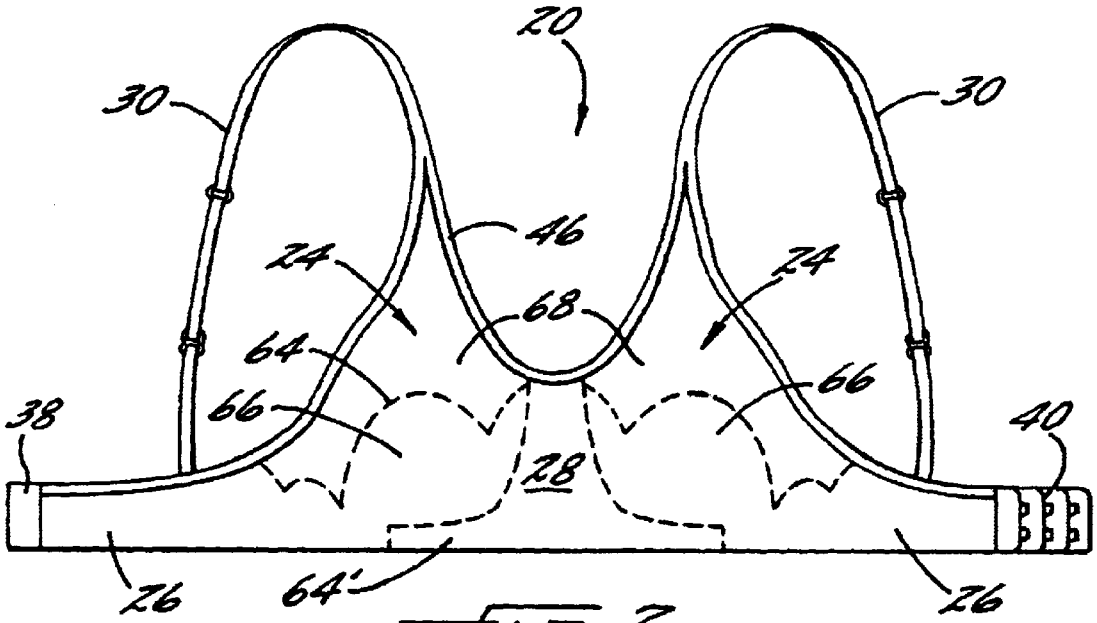
FIG. 2 is a plan view of the brassiere of FIG. 1.
Figure 3A:
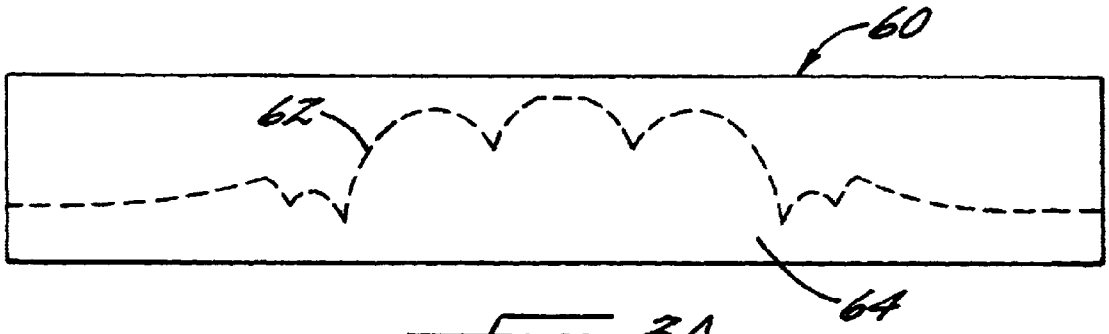
FIG. 3A is a plan view of a heat-bondable film prior to being cut along the indicated dashed line.
Figure 3B:
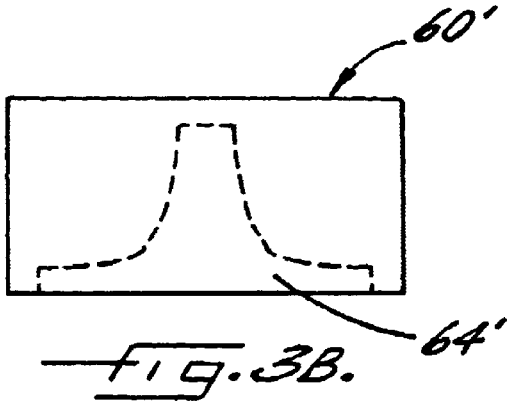
FIG. 3B is a plan view of another heat-bondable film prior to being cut along the indicated dashed line.
Figure 4:
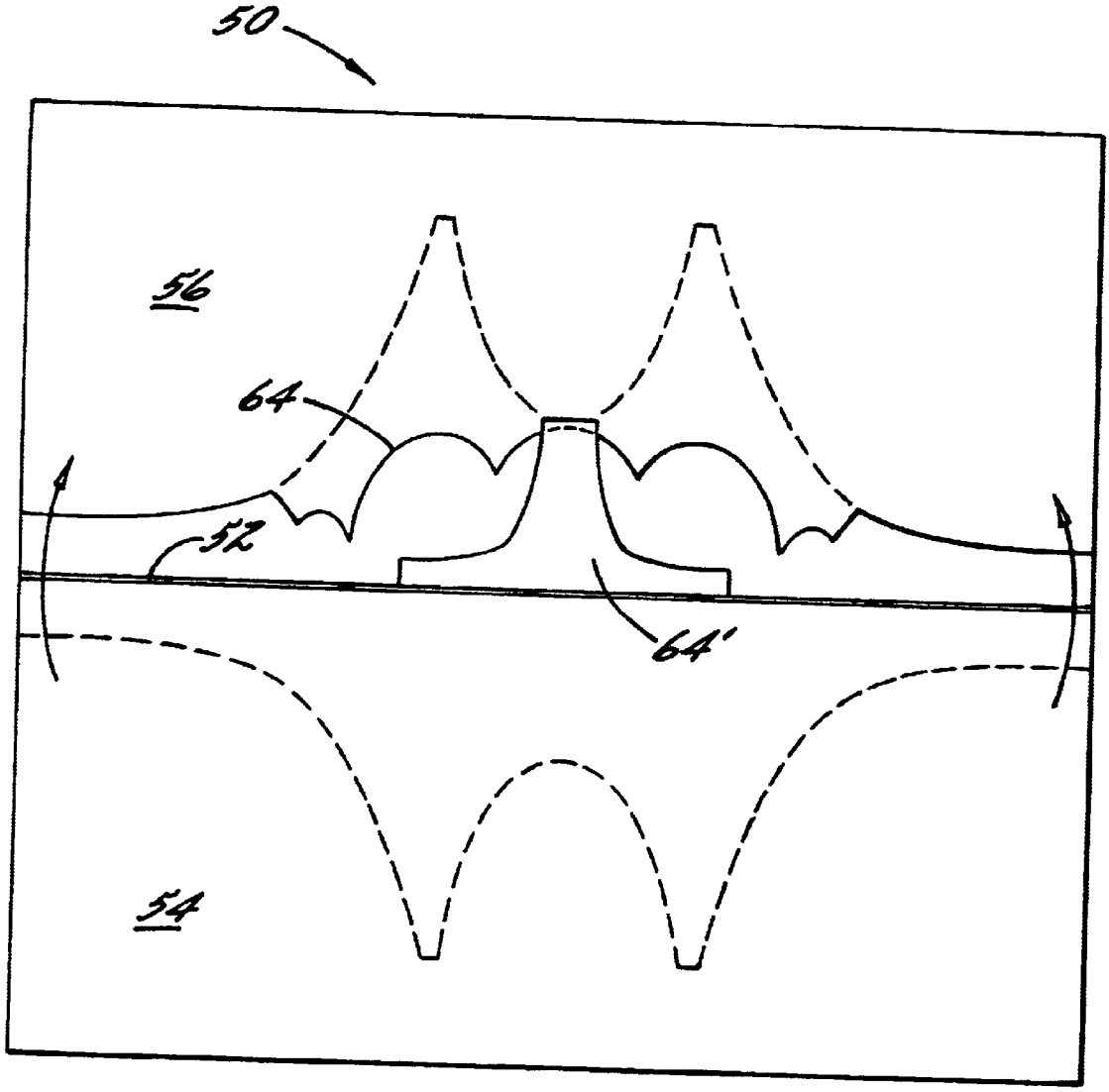
FIG. 4 is a plan view of a single-ply knit fabric blank with the cut heat-bondable film overlaid thereon.

Thus far, the construction of the brassiere is substantially the same as that described in commonly owned U.S. Pat. No. 6,287,168, which is incorporated herein by reference. The present invention differs from the prior brassiere in that a heat-bondable film is disposed between the plies in one or more selected areas for achieving certain effects that cannot as readily or effectively be achieved by knit construction alone. With reference to FIGS. 2–4, a brassiere and process for making same in accordance with the invention are now described. The brassiere 20, as noted above, is made as a two-ply construction from a single-ply fabric blank 50 shown in FIG. 4 in plan view. The blank is folded about a fold line 52 so that one ply 54 formed by one half of the blank overlies another ply 56 formed by the other half of the blank.

Prior to folding the blank, one or more pieces of heat-bondable film are disposed between the plies 54, 56. The heat-bondable film is sized and shaped to correspond to the size and shape of one or more areas in which it is desired to bond the two plies together. Thus, as shown in FIG. 3A, a strip or sheet of heat-bondable film 60 is cut along one or more cut lines 62 to provide a piece of heat-bondable film 64 having the desired size and shape. The film can be cut by die-cutting, with a Gerber system, by hand, etc. The resulting piece of heat-bondable film 64 is placed atop the inner surface of one of the plies such as the ply 56 in FIG. 4.

A second sheet of heat-bondable film 60' is cut along a cut line to form a second piece of heat-bondable film 64'. This piece of film in the illustrated embodiment is sized and shaped to cover the area of the central panel 28 of the brassiere as well as an area below each cup 24. The film 64' is placed atop the ply 56; as shown, the film 64' also overlies a portion of the first piece of film 64. Alternatively, the film pieces could be cut so that they do not overlap each other, if desired.

Once the piece or pieces of heat-bondable film are positioned on the blank, the blank is folded about the fold line 52 so that the heat-bondable film 64, 64' is sandwiched between the plies. The blank is then pressed in a heated press or the like to exert pressure on the blank while heating it. The heat-bondable film 64 preferably is a film of a heat-bondable polymer material. A preferred type of heat-bondable film is a polyurethane heat-bondable film having a thickness from about 135$\mu$ to 250$\mu$ (about 0.005 inch to 0.010 inch). For example, the heat-bondable polyurethane films sold by Framis Italia S.p.A. of Italy under the trademarks TEKFILM TRADÉL®, TEKFILM BI TRADÉL®, TEKFILM TRADÉL® LIGHT, and TEKFILM MIRAGE® can suitably be used in the present invention. The films are resiliently stretchable and have a high recovery so that when stretched and then released, they return to substantially their original unstretched length. The heat-bondable films are bonded to fabric by heating them to a temperature of about 180° C. for about 2 to 5 seconds while maintaining firm contact between the fabric and film. The two-ply fabric with the film disposed between the plies preferably is heated in a hot press. Alternatively, an ultrasonic unit can be used to heat the film and bond it to the plies.

When the two plies of the brassiere are bonded together with the heat-bondable film, two particularly notable effects are achieved. First, the areas bonded to the film have a resistance to stretching that depends on the properties of the film. Thus, the bonded areas can be given a substantially greater resistance to stretching than the fabric alone so as to provide greater support and shaping in those areas of the garment. Moreover, different regions of the garment can be given different degrees of resistance to stretching. Thus, for example, the heat-bondable film 64 can have a lower resistance to stretching than the film 64'. Another advantage of the invention is that garments having different support characteristics can be produced starting with identical fabric blanks, simply by using films with different properties.

The other notable effect imparted by inclusion of the heat-bondable film is an increase in the opacity of the two-ply fabric, even though the preferred films as described above are substantially transparent. Thus, garments can be given enhanced opacity in selected areas by bonding the plies together with heat-bondable film in those areas.

The drawings illustrate one possible configuration of bonded areas in a brassiere. The heat-bondable film 64 is positioned and configured to bond the plies together throughout the torso-encircling portion 26 and central panel 28 of the brassiere. The film 64 is also positioned to bond the plies together in lower portions 66 of the cups 24, while the upper portions 68 of the cups are left unbonded. The lower portions 66 of the cups are therefore more resistant to stretching than the upper portions 68, resulting in enhanced support for the breasts where it is needed. If desired, the heat-bondable film 64 can extend up the cups so as to cover the nipples for enhanced modesty, by virtue of the increased opacity imparted by the film.

The heat-bondable film 64' is configured and positioned to cover the area of the central panel 28 and marginal regions below each cup 24. The film 64' preferably has a very high resistance to stretching so that the brassiere in the region covered by the film 64' is substantially non-stretchable. This gives enhanced stability to the cups 24 so that they cannot move apart from each other to any significant extent. The film 64' can be made relatively less stretchable than the film 64 by making the film 64' of the same material but thicker, and/or by making the film 64' of a different material from that of the film 64.

The invention of course is not limited to any particular configuration and placement of the heat-bondable film or films, and various configurations and placements can be used for achieving different effects depending on the needs and desires of the manufacturer. For instance, a single piece of heat-bondable film can be positioned between the plies if only a single contiguous region is to be enhanced in support and/or opacity. Alternatively, multiple pieces of film can be spaced apart from each other if two or more non-contiguous regions are to be enhanced. In some region(s) of the garment, the film may comprise more than one layer of heat-bondable film stacked together. Thus, when the present specification and claims speak of bonding the fabric plies to the opposite faces of "the film", it is to be understood that "the film" can be a single layer of film or multiple layers of film.

Figure 5:
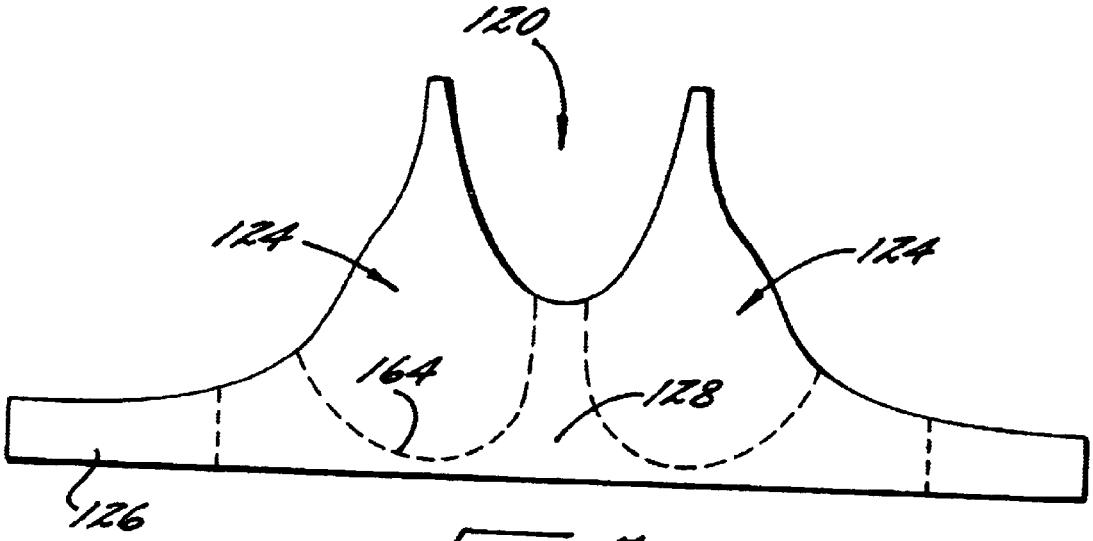
FIG. 5 is a plan view of a body-covering portion of a brassiere in accordance with another alternative embodiment of the invention.

FIG. 5 shows an alternative embodiment of a two-ply brassiere fabric blank 120 in accordance with the invention. The blank 120 includes cups 124, torso-encircling portion 126, and central panel 128 similar to the previously described brassiere 20. The blank 120 is for making a non-underwire brassiere having functional attributes of an underwire brassiere. To this end, the blank includes one or more pieces of heat-bondable film 164 that extend(s) below the cups 124. The film 164 is substantially non-stretchable. An upper edge of the film 164 follows a generally U-shaped course along the lower edge of each cup, i.e., in the shape that a conventional underwire would typically have. The film 164 gives the wearer a feeling of stability and support similar to an underwire, by pressing inward on the body beneath the breasts.

It is also possible to incorporate other features into the brassieres described above. For instance, the fabric blank can be knit with different knit constructions in different regions of the blank for achieving various aesthetic and/or functional effects. As an example, the central panel 28, 128 can be knit to have a greater resistance to stretching than the other portions of the blank to provide enhanced stability to the cups. Other knit-in support and/or shaping features can be included.

Figure 6:
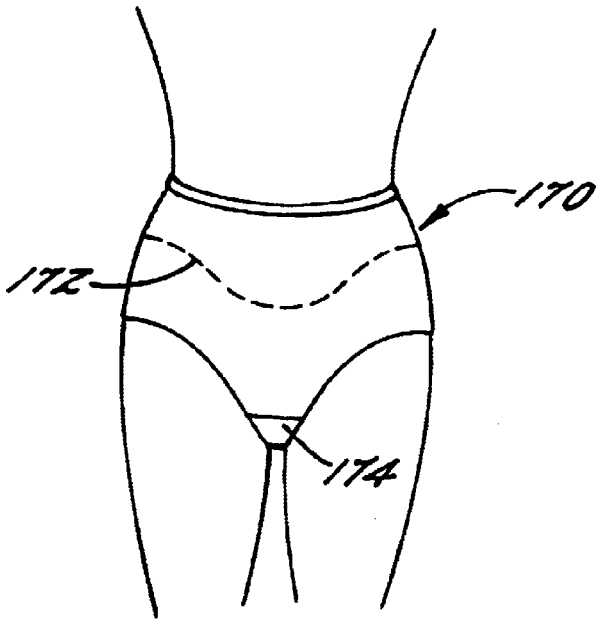
FIG. 6 shows one embodiment of a panty in accordance with the present invention.

As noted previously, the invention is not limited to brassieres. The invention can also be applied to other types of support garments such as girdles, body suits, panties, and the like. For instance, FIG. 6 shows a body-shaping panty 170 in accordance with the invention. The panty 170 is a two-ply construction. An abdominal control panel 172 is provided for flattening the abdomen. The control panel 172 is formed by bonding a heat-bondable film between the two plies. The film preferably has a sufficient resistance to stretching to give the control panel 172 a substantially greater resistance to stretching than the rest of the torso-encircling part of the panty. The control panel 172 can extend around the wearer's back so that it fully encircles the torso, if desired.

Instead of or in addition to the abdominal control panel 172, the panty can include panels for shaping and/or slimming other parts of the body such as the buttocks, hips, etc. An another alternative, it is possible to include the heat-bondable film in the entire torso-encircling part of the panty, except for the crotch 174, to provide an all-over slimming panty.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A method for making a garment, comprising:

overlaying a fabric ply upon another fabric ply to form a two-ply blank wherein substantially the entire blank has two plies;

positioning at least one piece of heat-bondable polymer film between the two plies of the blank in at least one selected area thereof, constituting less than the entire blank, at which enhanced body support is desired, the heat-bondable film having a resistance to stretching greater than that of the fabric alone;

heating the blank to bond the plies to the heat-bondable film in the at least one selected area such that the plies in the at least one selected area are bonded to each other, the plies outside that at least one selected area being unbonded to each other; and fashioning a two-ply garment from the blank, whereby substantially the entire garment has two plies, and the garment in the at least one selected area has a greater resistance to stretching than the fabric alone.

2. The method of claim 1, wherein the heat-bondable film is cut to have a size and shape corresponding to that of the at least one selected area in which greater resistance to stretching is desired, and the cut heat-bondable film is then positioned between the plies and heated to bond the plies together.

3. The method of claim 1, wherein the step of fashioning a garment comprises fashioning a brassiere, and wherein the heat-bondable film is sized and positioned to bond the plies thereto in lower regions of cups of the brassiere while the plies in upper regions of the cups are left unbonded.

4. The method of claim 1, wherein the step of fashioning a garment comprises fashioning a brassiere, and wherein the heat-bondable film covers a region below each cup of the brassiere with an upper edge of the film following a generally U-shaped arc below the cup, the heat-bondable film being substantially non-stretchable so as to stabilize the cups in the manner of underwires.

5. The method f claim 1, wherein a first piece of heat-bondable film having a first resistance to stretching is positioned in a first region between the plies and a second piece of heat-bondable film having a second resistance different from the first resistance is positioned in a second region between the plies.

6. The method of claim 5, wherein the first and second pieces of heat-bondable film are of different thickness.

7. The method of claim 5, wherein the first and second pieces of heat-bondable film are of different modulus.

8. A garment, comprising:

a two-ply fabric body configured to encircle a part of a person's body, wherein substantially the entire fabric body has two plies;

wherein the two plies of the fabric body are bonded to a heat-bondable polymer film positioned between the plies and heated to bond the plies to opposite faces of the film, the heat-bondable film occupying less than the entire fabric body such that there are regions of the fabric body outside the heat-bondable film wherein the plies are unbonded to each other, the heat-bondable film having a greater resistance to stretching than the fabric alone, the heat-bondable film being cut to a desired shape and size prior to being positioned between the plies, whereby the at least one selected area in which the plies are bonded to the film comprises a precisely defined region of the fabric body having an enhanced resistance to stretching.

9. The garment of claim 8, wherein the heat-bondable film comprises a single layer of heat-bondable film.

10. The garment of claim 8, wherein the garment comprises a brassiere and the at least one selected area comprises a partial region of each cup of the brassiere.

11. The garment of claim 10, wherein the partial region of each cup comprises a lower region of the cup.

12. The garment of claim 8, wherein the garment comprises a brassiere and the at least one selected area comprises a central panel between cups of the brassiere.

13. The garment of claim 12, wherein the heat-bondable film in the central panel is substantially non-stretchable.

14. The garment of claim 8, wherein the garment comprises a brassiere and the heat-bondable film covers a region below each cup with an upper edge of the film following a generally U-shaped arc below the cup, the heat-bondable film being substantially non-stretchable so as to stabilize the cups in the manner of underwires.

15. The garment of claim 8, wherein the garment comprises a brassiere and the fabric body comprises a single ply fabric folded about a lower edge of the brassiere to form the two plies.

16. The garment of claim 15, wherein upper edges of the two plies are joined together by elastic banding sewn therealong.

17. The garment of claim 8, wherein the heat-bondable film comprises polyurethane.

18. The garment of claim 8, wherein a first region of the garment includes a heat-bondable film having a first resistance to stretching, and a second region of the garment includes a heat-bondable film having a second resistance to stretching different from the first resistance to stretching, whereby the first and second regions have different degrees of resistance to stretching.

19. The garment of claim 8, wherein the garment comprises a lower-body undergarment.

20. The garment of claim 19, wherein the garment comprises a panty.

21. A garment, comprising:

a generally non-opaque fabric body having two plies connected to each other along edges of the fabric body, and wherein substantially the entire fabric body has two plies;

wherein a partial region of the fabric body has a greater opacity than other portions of the fabric body for enhanced modesty, said part having greater opacity being provided by bonding the two plies together with a heat-bondable polymer film disposed therebetween, regions of the fabric body outside said heat-bondable film having the two plies unbonded to each other.

22. The garment of claim 21, wherein the heat-bondable film is substantially transparent.

23. The garment of claim 21, wherein the garment comprises a brassiere and said part having greater opacity covers a partial region of each cup of the brassiere.

24. The garment of claim 23, wherein said part having greater opacity is configured and positioned to cover the nipples of a person wearing the brassiere.

* * * * *